US008849176B2

(12) United States Patent
Recinto et al.

(10) Patent No.: US 8,849,176 B2
(45) Date of Patent: Sep. 30, 2014

(54) AUTOMATIC DOCUMENT FEEDER AND MEDIA RECORD EQUIPMENT USING THE SAME

(75) Inventors: Michael Medrano Recinto, Singapore (SG); Domingo Jr. Abao Vicente, Singapore (SG); Cher-Lek Toh, Singapore (SG); Chen-Fu Huang, New Taipei (TW); Harold Magtibay Cabral, Singapore (SG)

(73) Assignees: Cal-Comp Precision (Singapore) Limited, Singapore (SG); Cal-Comp Electronics & Communications Company Limited, New Taipei (TW)

( * ) Notice: Subject to any disclaimer, the term of this patent is extended or adjusted under 35 U.S.C. 154(b) by 205 days.

(21) Appl. No.: 13/551,577

(22) Filed: Jul. 17, 2012

(65) Prior Publication Data

US 2013/0336696 A1 Dec. 19, 2013

(30) Foreign Application Priority Data

Jun. 19, 2012 (SG) ..... 201204538-1

(51) Int. Cl.
*G03G 15/00* (2006.01)
*G03G 21/00* (2006.01)

(52) U.S. Cl.
USPC ..... 399/367

(58) Field of Classification Search
CPC ..... H04N 1/00543; H04N 1/00546; B65H 2601/11; B65H 1/00; G03G 15/00; G03G 21/00
USPC ..... 399/367
See application file for complete search history.

(56) References Cited

U.S. PATENT DOCUMENTS

| | | | | |
|---|---|---|---|---|
| 5,008,715 | A * | 4/1991 | Imaizumi et al. | 399/392 |
| 6,536,762 | B1 | 3/2003 | Sheng et al. | |
| 7,549,627 | B2 | 6/2009 | Lin et al. | |
| 2005/0158091 | A1 * | 7/2005 | Oya et al. | 399/367 |
| 2005/0207809 | A1 * | 9/2005 | Ho et al. | 399/367 |
| 2010/0061781 | A1 * | 3/2010 | Won | 399/367 |
| 2011/0200359 | A1 * | 8/2011 | Hayakawa | 399/119 |

FOREIGN PATENT DOCUMENTS

| | | | | |
|---|---|---|---|---|
| JP | 62047678 A * | 3/1987 | | G03G 15/20 |
| TW | 503836 | 9/2002 | | |

OTHER PUBLICATIONS

"Office Action of Taiwan Counterpart Application", issued on Jun. 23, 2014, pp. 1-5.

* cited by examiner

*Primary Examiner* — Nguyen Ha
(74) *Attorney, Agent, or Firm* — Jianq Chyun IP Office

(57) ABSTRACT

An automatic document feeder and a media record equipment using the same are provided. The automatic document feeder includes a frame, a cover and a gear chain. An end of the cover pivoted to the frame has a cam. The gear chain disposed in the frame has multiple driven gears and a rotating unit. The driven gears engaged with each other rotate about a first axial direction. The rotating unit having a first rock arm contacting the cam and a second rock arm with one of the driven gears disposed thereon is capable of rotating about the first axial direction. The cam pushes the first rock arm to drive the rotating unit to rotate about the first axial direction, and then an engagement between the driven gear on the second rock arm is released by departing from another driven gear engaged therewith when the cover opens relative to the frame.

26 Claims, 13 Drawing Sheets

AUTOMATIC DOCUMENT FEEDER AND MEDIA RECORD EQUIPMENT USING THE SAME

CROSS-REFERENCE TO RELATED APPLICATION

This application claims the priority benefit of Singapore application serial no. 201204538-1, filed on Jun. 19, 2012. The entirety of the above-mentioned patent application is hereby incorporated by reference herein and made a part of this specification.

BACKGROUND OF THE INVENTION

1. Field of the Disclosure

The present invention is related to an automatic document feeder and a media record equipment, and more particularly, to an automatic document feeder and a media record equipment with convenience of jam releasing for a user.

2. Description of Related Art

Different sorts of electronic devices have been gradually developed and become necessary tools in daily lives. For example, equipments such as computers, printers, fax machines and photocopiers are configured in an office for document processing. Work efficiency of printers, photocopiers and fax machines related to paper are influenced by faculty of paper feeding.

Take the multi-function printer compatible of print and photocopy as an example, an automatic document feeder (ADF) disposed on the multi-function printer is used to feed blank paper into the multi-function printer for printing or photocopying. A user often puts a stack of paper in a paper tray of the ADF device before copying, printing, or scanning. When copying, printing or scanning is performed, paper is transmitted in the multi-function printer by ADF, and then images are formed on paper through the printer.

FIG. 1 is a schematic view of a conventional paper feeding device, and FIG. 2 is a perspective view of inner of the paper feeding device of FIG. 1. Referring to FIGS. 1 and 2, the conventional paper feeding device includes a feeding roller 10, a separate roller 20, a scan roller 30, a scan module 40, an eject roller 50, a first gear chain 60, a motor 70, a second gear chain 80 and a jam release device 90. By means of the motor 70 to drive the first gear chain 60, the second gear chain 80 and multiple connecting rollers, after paper 1 is transferred to the conventional paper feeding device, paper 1 passes through the feeding roller 10, the separate roller 20, the scan roller 30 and the scan module 40 orderly, and then is ejected outside of the main body of the paper feeding device by the eject roller 50. The cover of the conventional paper feeding device has to be opened when paper 1 is jammed between the feeding roller 10 and the separate roller 20 for a user to release the jammed paper 1. In detail, a user rotates the jam release device 90 to release the paper 1 jammed between the scan roller 30 and the eject roller 50, so as to eject the jammed paper 1.

However, due to tight engagement between the feeding roller 10, the separate roller 20, the scan roller 30, the motor 70 and the second gear chain 80, even when the motor 70 stops operating, it is still hard for the user to release the paper jammed between the rollers.

SUMMARY OF THE DISCLOSURE

The invention provides an automatic document feeder (ADF) with jam release function which is convenient in use.

The invention provides a media record equipment having the above-mentioned ADF with jam release function which is convenient in use.

The present invention provides an automatic document feeder including a frame, a cover and a gear chain. An end of the cover is pivoted to the frame and therefore the cover could be open or close relative to the frame, and the end of the cover pivoted to frame has a cam. The gear chain disposed in the frame has multiple driven gears and a rotating unit. The driven gears engage with each other and are disposed with a first axial direction as a rotating axle. The rotating unit is also disposed with the first axial direction as the rotating axle and has a first rock arm and a second rock arm, wherein the cam contacts the first rock arm and one of the driven gears is disposed on the second rock arm. The cam pushes the first rock arm to drive the rotating unit to rotate about the first axial direction, and then an engagement between the driven gear disposed on the second rock arm and another driven gear engaged therewith is released by departing the driven gear disposed on the second rock arm from the driven gear engaged therewith when the cover opens relative to the frame.

In one embodiment of the automatic document feeder, wherein the first rock arm has an L-shaped opening, and the cam is located in the L-shaped opening when the cover is close to the frame.

In one embodiment of the automatic document feeder, wherein the cam is a shaft, and the shaft distances from the corner of the L-shaped opening when the cover is close to the frame.

In one embodiment of the automatic document feeder, wherein the cover has a propping element while the first rock arm has a first guiding arc, and the propping element props the first rock arm when the cover is close to the frame. The propping element moves along a profile of the guiding arc when the cover is open to the frame.

In one embodiment of the automatic document feeder, wherein the first rock arm has a U-shaped opening while the cam is a shaft, and the shaft is located in the U-shaped opening when the cover is close to the frame.

In one embodiment of the automatic document feeder, wherein the cam has a first tooth portion, the first rock arm has a second tooth portion, and the first tooth portion is engaged with the second tooth portion.

In one embodiment of the automatic document feeder, the gear chain further comprises a driving gear disposed with a second axial direction perpendicular to the first axial direction as the rotating axle, and the driving gear is engaged with one of the driven gears.

In one embodiment of the automatic document feeder, wherein the driven gear engaged with the driving gear is different from the driven gear disposed on the second rock arm.

In one embodiment of the automatic document feeder, further comprising a plurality of fixing units while the frame has a plurality of fixing structures disposed around outside of the driven gears, wherein the fixing structures are apertures, and the fixing units such as screws or bolts pass through the fixing structures individually.

In one embodiment of the automatic document feeder, further comprising an elastic element connected between the first rock arm and the frame, wherein the elastic element is a spring or a rubber band, each of a bottom of the frame and the first rock arm has a hook ring, and two ends of the elastic element connect to the hook rings individually.

The invention further provides a media record equipment including a main body and an automatic document feeder disposed on the main body. The automatic document feeder includes a frame, a cover and a gear chain, wherein an end of the cover is pivoted to the frame and therefore the cover could be open or close relative to the frame, and the end of the cover pivoted to frame has a cam. The gear chain disposed in the frame has multiple driven gears and a rotating unit. The driven gears engage with each other and are disposed with a first axial direction as a rotating axle. The rotating unit is also disposed with the first axial direction as the rotating axle and has a first rock arm and a second rock arm, wherein the cam contacts the first rock arm and one of the driven gears is disposed on the second rock arm. The cam pushes the first rock arm to drive the rotating unit to rotate about the first axial direction, and then an engagement between the driven gear disposed on the second rock arm and another driven gear engaged therewith is released by departing the driven gear disposed on the second rock arm from the driven gear engaged therewith when the cover opens relative to the frame.

In one embodiment of the media record equipment, wherein the first rock arm has an L-shaped opening, and the cam is located in the L-shaped opening when the cover is close to the frame.

In one embodiment of the media record equipment, wherein the cam is a shaft, and the shaft distances from the corner of the L-shaped opening when the cover is close to the frame.

In one embodiment of the media record equipment, wherein the cover has a propping element while the first rock arm has a first guiding arc, and the propping element props the first rock arm when the cover is close to the frame. The propping element moves along a profile of the guiding arc when the cover is open to the frame.

In one embodiment of the media record equipment, wherein the first rock arm has a U-shaped opening while the cam is a shaft, and the shaft is located in the U-shaped opening when the cover is close to the frame.

In one embodiment of the media record equipment, wherein the cam has a first tooth portion, the first rock arm has a second tooth portion, and the first tooth portion is engaged with the second tooth portion.

In one embodiment of the media record equipment, wherein the gear chain further comprises a driving gear disposed with a second axial direction perpendicular to the first axial direction as the rotating axle, and the driving gear is engaged with one of the driven gears.

In one embodiment of the media record equipment, wherein the driven gear engaged with the driving gear is different from the driven gear disposed on the second rock arm.

In one embodiment of the media record equipment, further comprising a plurality of fixing units while the frame has a plurality of fixing structures disposed around outside of the driven gears, wherein the fixing structures are apertures, and the fixing units such as screws or bolts pass through the fixing structures to fix the frame on the main body.

In one embodiment of the media record equipment, further comprising an elastic element connected between the first rock arm and the frame, wherein the elastic element is a spring or a rubber band, each of a bottom of the frame and the first rock arm has a hook ring, and two ends of the elastic element connect to the hook rings individually.

Based on the above disclosure, in the automatic document feeder and the media record equipment using the same of the present invention, a cam is disposed on an end the cover to interfere the rotating unit, and therefore when the cover is open relative to the frame, the rotation of the cam drives the rotating unit to rotate, so as to release the engagement between the driven gear disposed on the rotating unit and another driven gear engaged therewith. Thereby, the rest of the driven gears of the gear chain can rotate freely, and the user can easily and conveniently release the paper jammed in the driven gears of the gear chain.

In order to make the aforementioned features and advantages of the invention more comprehensible, embodiments accompanied with figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DETAILED DESCRIPTION OF THE EMBODIMENTS

First Embodiment

Figure 1:
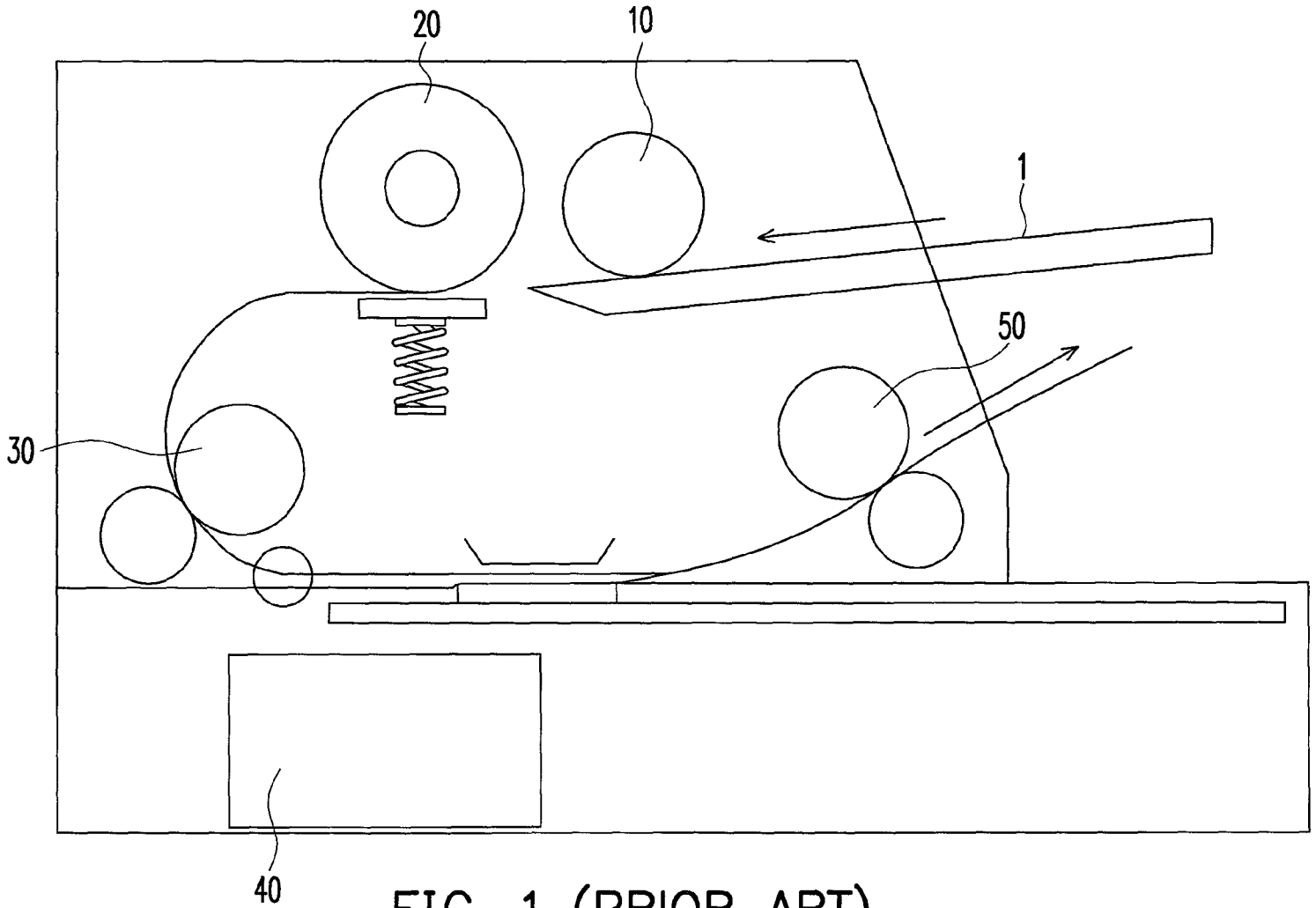
FIG. 1 (PRIOR ART)
FIG. 1 is a schematic view of a conventional paper feeding device.
Figure 2:
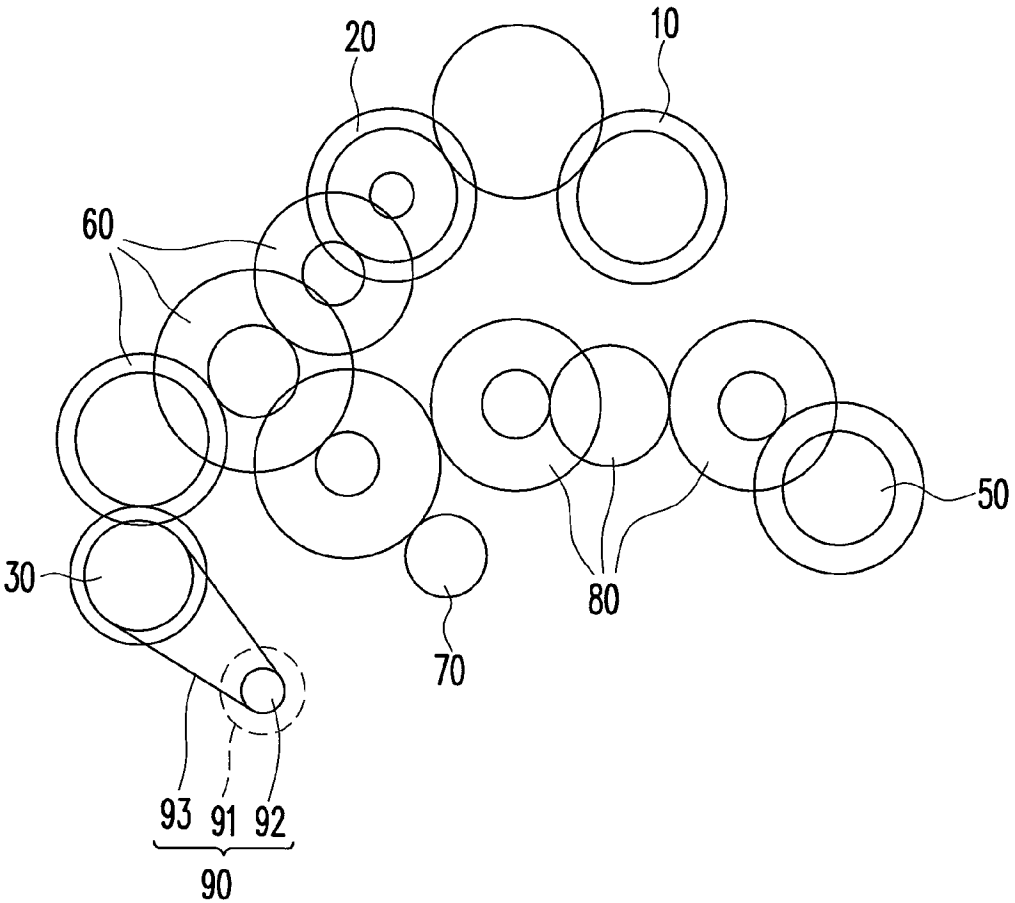
FIG. 2 (PRIOR ART)
FIG. 2 is a perspective view of inner of the paper feeding device of FIG. 1.
Figure 3:
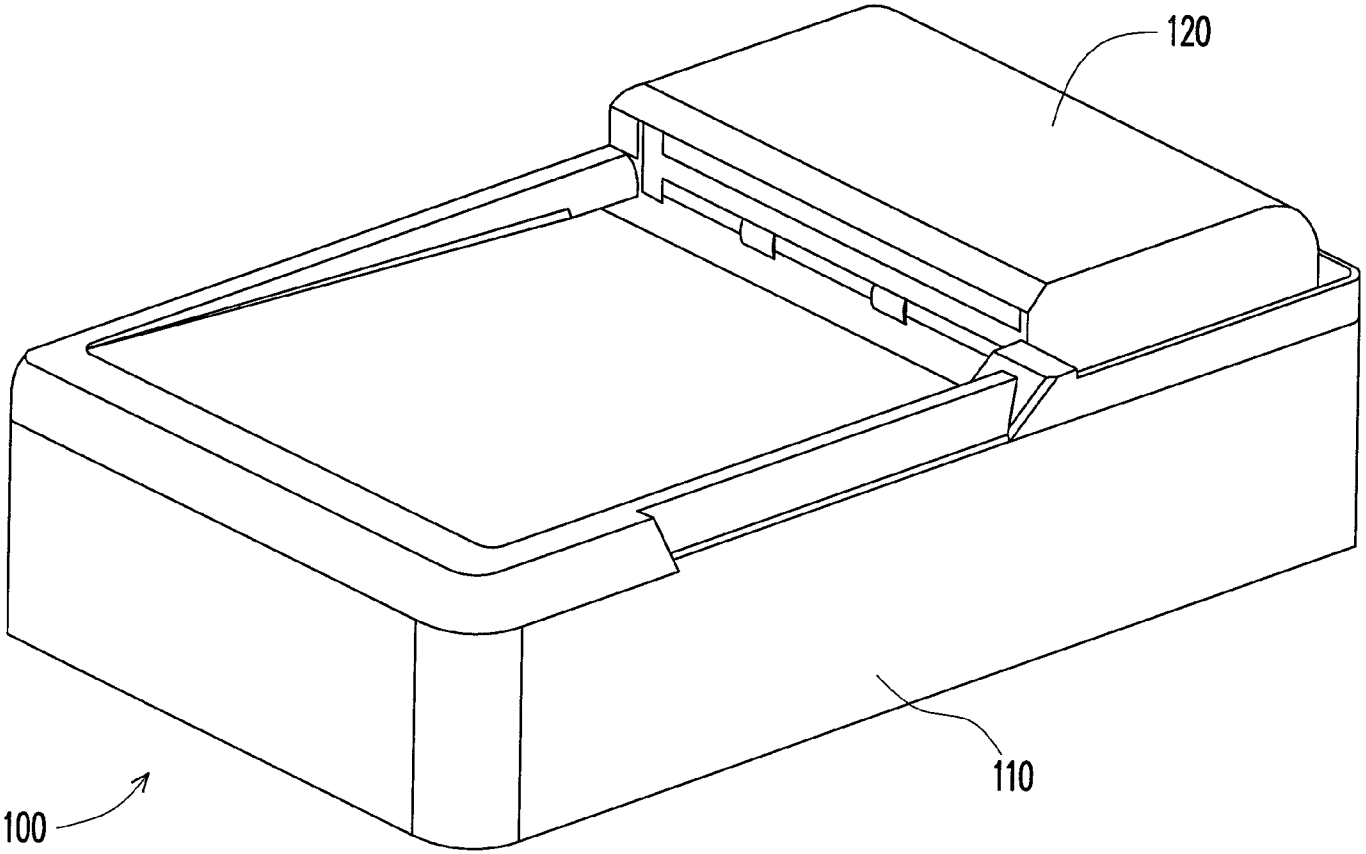
FIG. 3 is a schematic view of a media record equipment according to a first embodiment.
Figure 4:
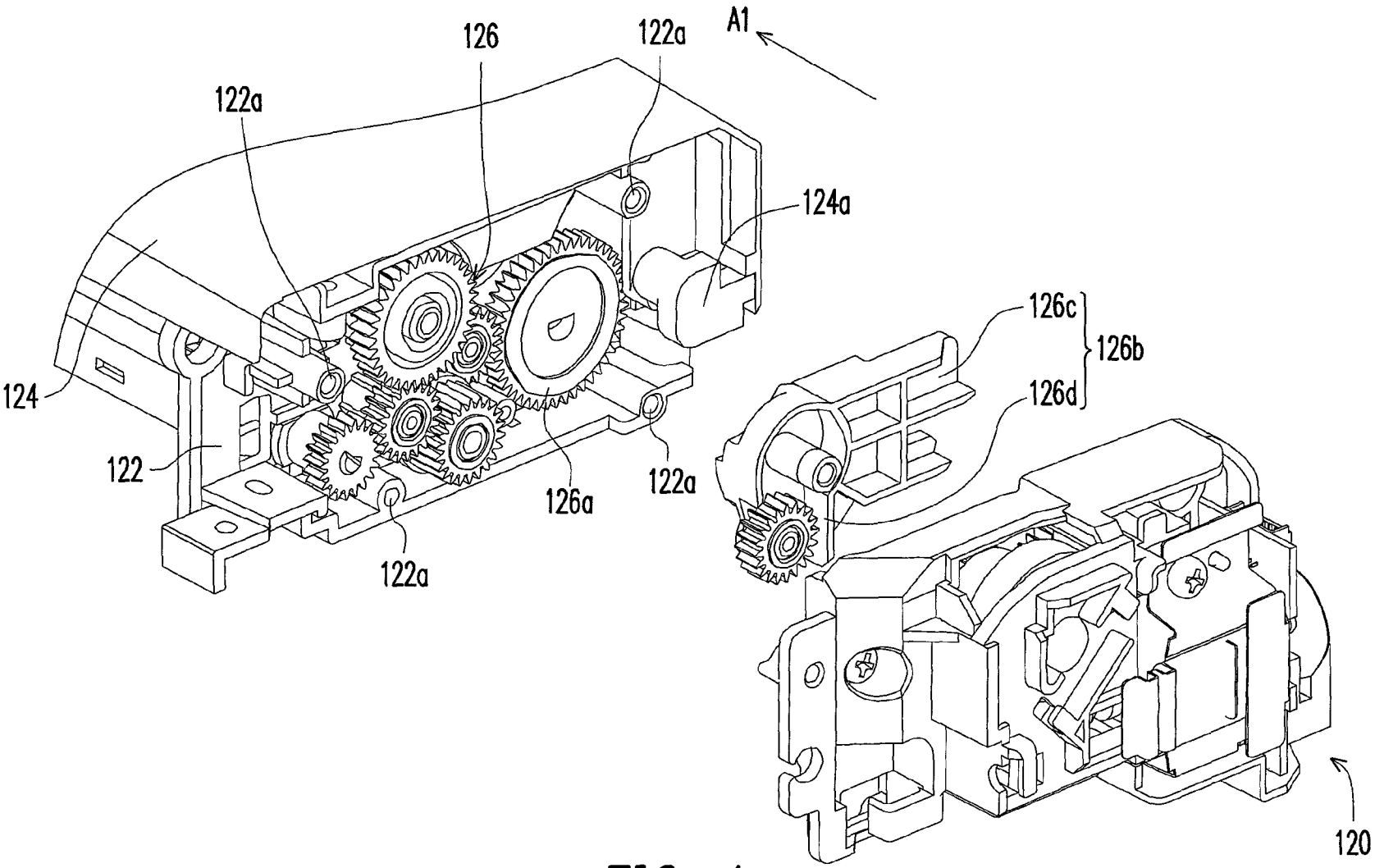
FIG. 4 is an exploded view of an automatic document feeder of the media record equipment in FIG. 3.
Figure 5:
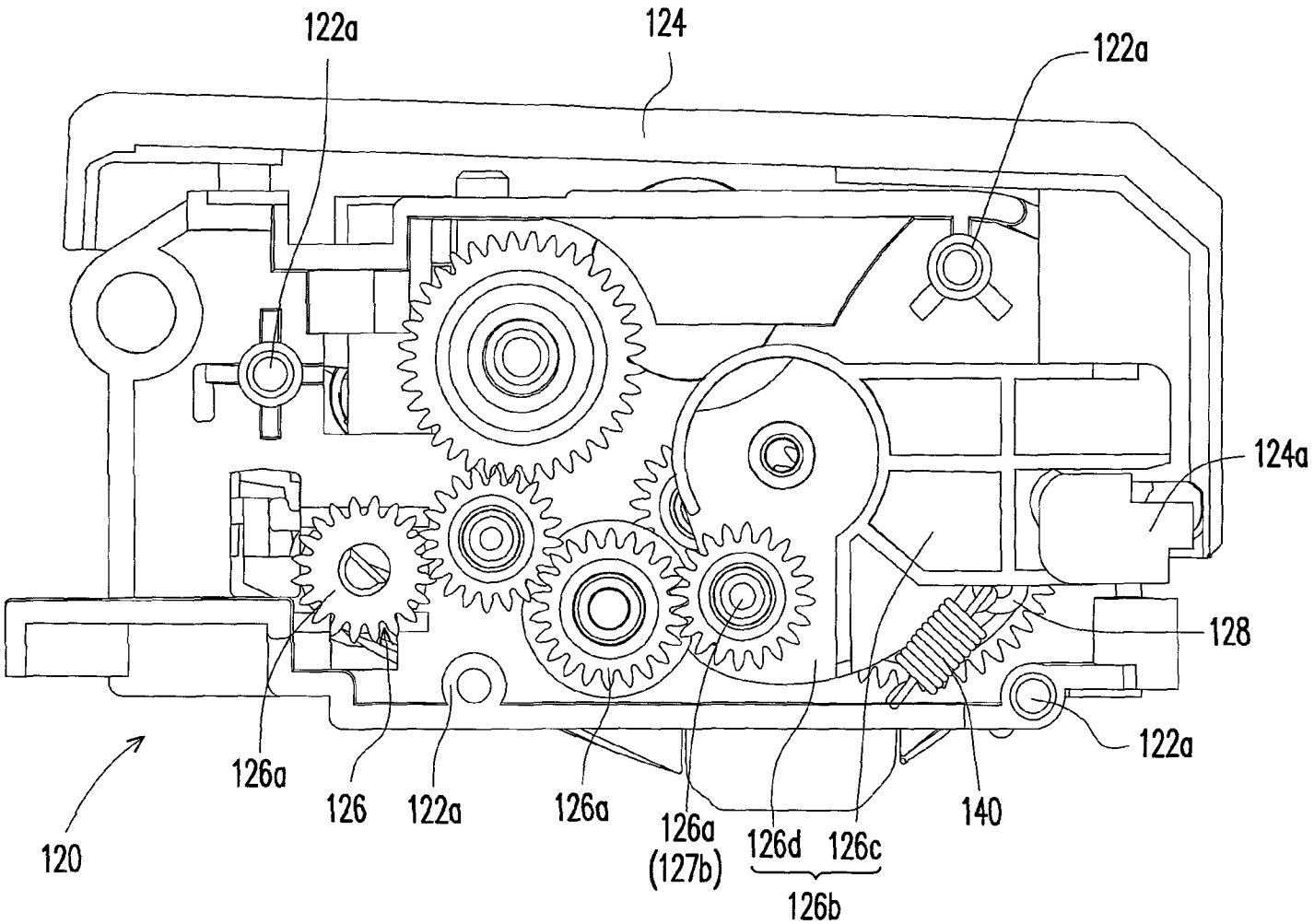
FIG. 5 is a schematic view of an assembly of the automatic document feeder in FIG. 4.

FIG. 3 is a schematic view of a media record equipment according to a first embodiment of the present invention. FIG. 4 is an exploded view of an automatic document feeder of the media record equipment in FIG. 3. FIG. 5 is a schematic view of an assembly of the automatic document feeder in FIG. 4. Referring to FIGS. 3 to 5, the media record equipment 100 includes a main body 110 and an automatic document feeder 120 disposed on the main body 110. The automatic document feeder 120 includes a frame 122, a cover 124 and a gear chain 126, wherein an end of the cover 124 is pivoted to the frame 122 and therefore the cover 124 could be open or close relative to the frame 122, and the end of the cover 124 pivoted to frame 122 has a cam 124*a*. The gear chain 126 disposed in the frame 122 includes a plurality of driven gears 126*a* and a rotating unit 126*b*, wherein the driven gears 126*a* are disposed with the first axial direction A1 as a rotating axle, and the driven gears 126*a* engage with each other when the cover 124 is close relative to the frame 122. The rotating unit 126*b* is also disposed with the first axial direction A1 as the rotating axle and having a first rock arm 126*c* and a second rock arm 126*d*, wherein the cam 124*a* contacts the first rock arm 126*c* and one of the driven gear 126*a* is disposed on the second rock arm 126*d*.

Figure 6:
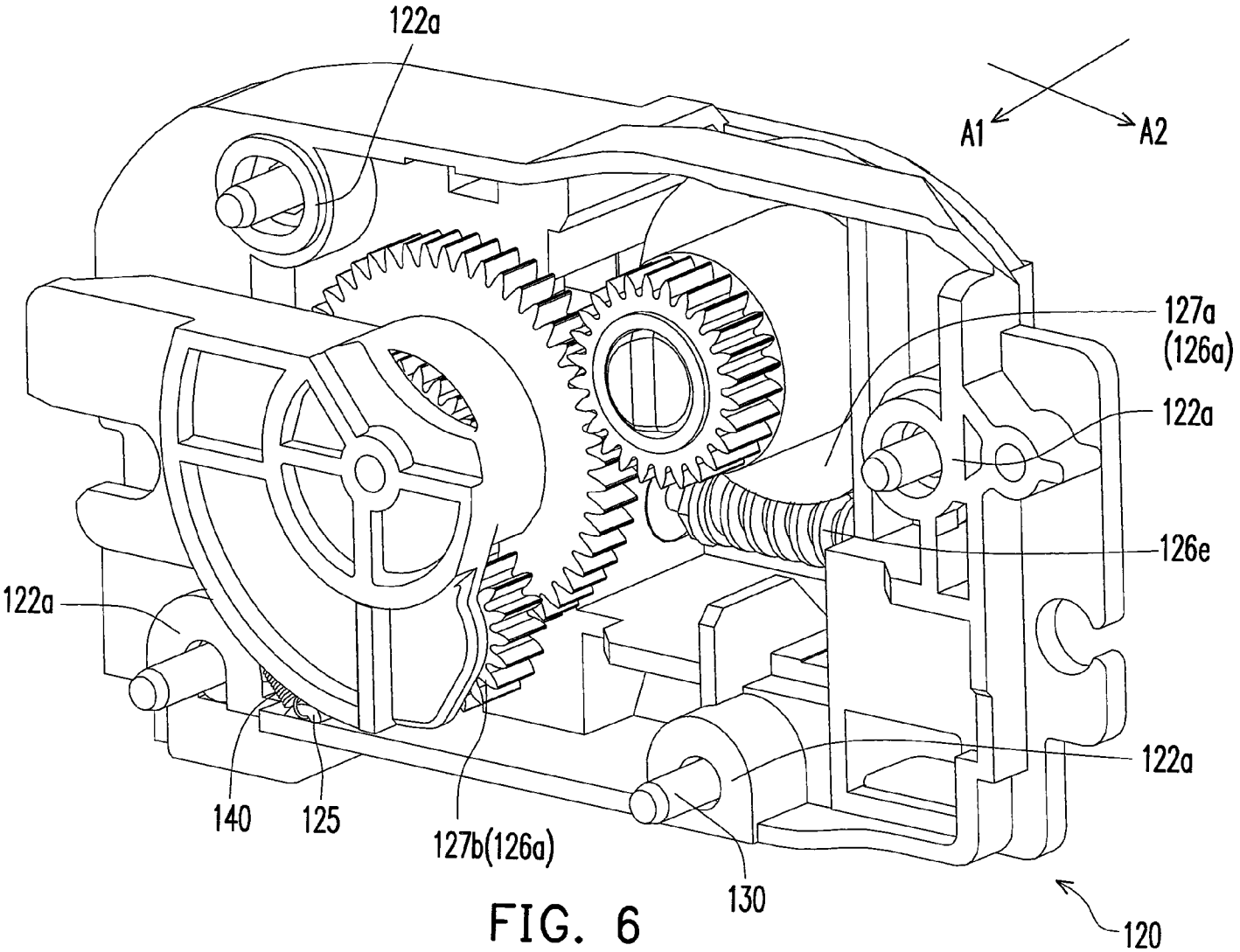
FIG. 6 is a partial view of the assembly of the automatic document feeder in FIG. 4.

FIG. 6 is a partial view of the assembly of the automatic document feeder in FIG. 4. Referring to FIGS. 4 to 6, the gear chain 126 of the present embodiment further comprises a driving gear 126*e* disposed with a second axial direction A2 perpendicular to the first axial direction A1 as the rotating axle. The driving gear 126*e* is a worm wheel connected to the motor (not shown) and engages with one of the driven gear 126*a*. The moment output by the motor (not shown) is transferred through the driving gear 126*e* to a driven gear 126*a* engaged with the driving gear 126*e*, such that the driven gears 126*a* engaged with each other start to rotate and the automatic document feeder 120 starts to feed paper.

In the present embodiment, the driven gear 126*a* engaged with the driving gear 126*e* is different from the driven gear 126*a* disposed on the second rock arm 126*d*, and therefore the reference number of the driven gear 126*a* engaged with the driving gear 126*e* is labeled as 127*a* for distinguishing from the driven gear 126*a* disposed on the second rock arm 126*d* labeled as 127*b*. Herein, the difference between the driven gears 127*a* and 127*b* means that the driven gears 127*a*, 127*b* are in different locations, and therefore each of the driven gears 127*a*, 127*b* is engaged with different driven gears 126*a*. Rotating directions such as counterclockwise or clockwise of the driven gears 126*a* and a rotating sequence of the driven gears 126*a* of the gear chain 126 are related to individual locations of the driven gears 126*a* and related to a rotating direction of the driving gear 126*e*. The driven gears 126*a* applied in the gear chain 126 may have same or different shape, size and tooth distance, which depends on actual requirements and is not limited by the present application. In other embodiments not illustrated in figs, the driven gear 126*a* engaged with the driving gear 126*e* can also be the same driven gear 126*a* that is disposed on the second rock arm 126*d*. Persons having ordinary skill in the art can change locations of correlative elements by adapted modifications.

Furthermore, since the frame 122 needs to be fixed on the main body 110, the frame 122 of the present embodiment further has a plurality of fixing structures 122*a* disposed around outside of the driven gears 126*a*. The fixing structures 122*a* in the present embodiment are apertures, and correspondingly, the media record equipment 100 further has a plurality of fixing units 130, wherein the fixing units 130 pass through the fixing structures 122*a* to fix the frame 122 onto the main body 110. The fixing units 130 applied in the embodiment may be selected from screws or bolts, depends on actual requirements. Though the fixing units 130 applied in the embodiment are screws and bolts, and the fixing structures 122*a* applied in the embodiment are apertures, persons skilled in the art know that manners of fixing the frame 122 on the main body 110 are not limited by the present embodiment, and the frame 122 may also be fixed on the main body 110 by wedging, tight fastening, . . . etc.

The motor (not illustrated) drives the driving gear 126*e* to rotate when the media record equipment 100 starts photocopying or printing, the driven gear 127*a* engaged with the driving gear 126*e* is driven by the driving gear 126*e* to rotate and further to drive other driven gears 126*a* engaged with each other to rotate. Therefore, the automatic document feeder 120 starts to feed and transfer paper.

Figure 7:
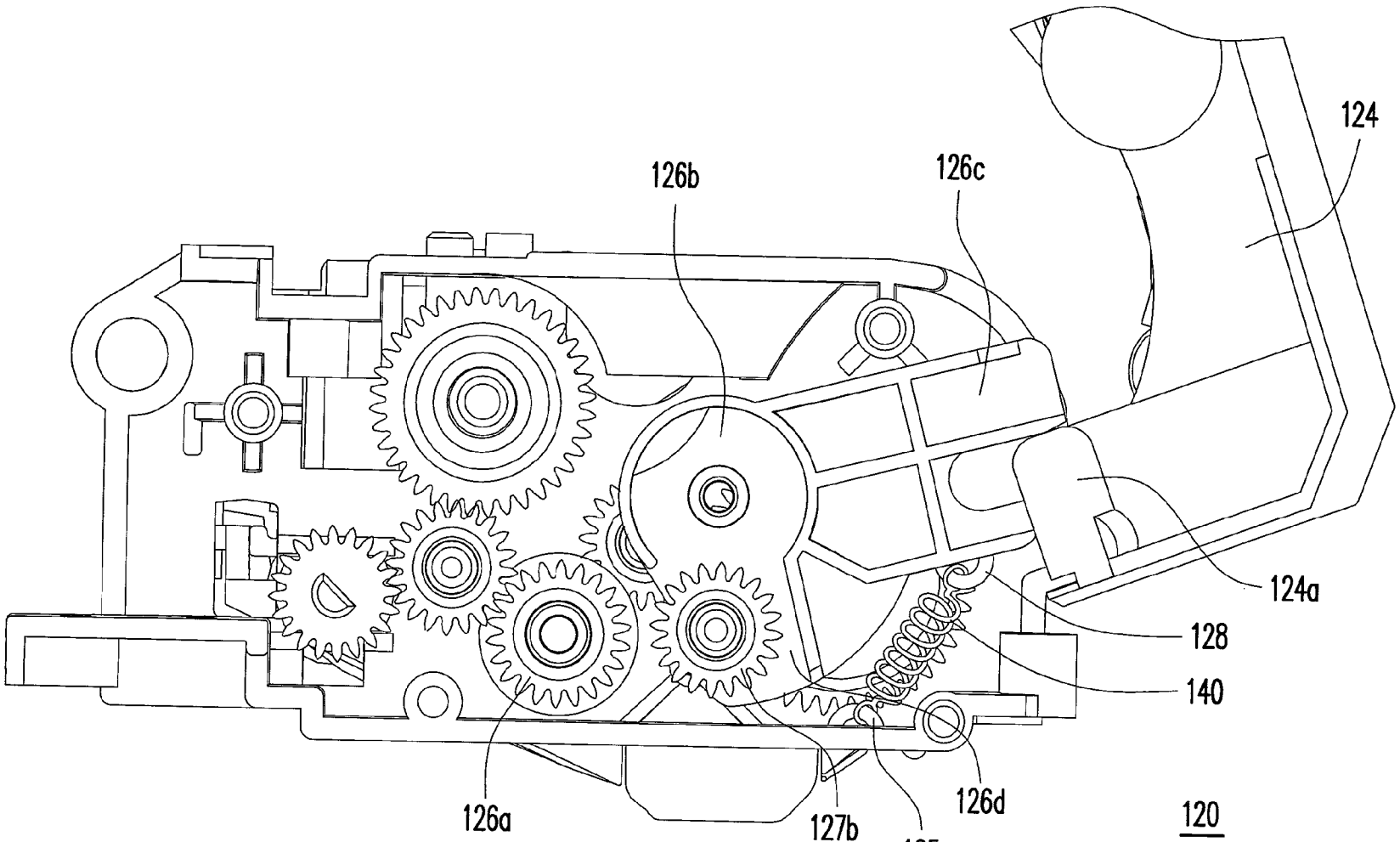
FIG. 7 is a schematic view of the driven gear disposed on the second rock arm departs from the driven gear engaged therewith of the automatic document feeder in FIG. 5.

However, when the paper is jammed in the automatic document feeder 120, the user has to eject the paper from the automatic document feeder 120. In particularly, the user only has to open the cover 124 relative to the frame 122, and therefore the cam 124*a* interfered with the first rock arm 126*c* of the rotating element 126*b* rotates with the rotation of the cover 124 and pushes the first rock arm 126*a* simultaneously, and thus the rotating element 126*b* rotates about the first axial direction A1 counterclockwise. Thus, the second rock arm 126*d* also rotates counterclockwise and departs from the driven gear 126*a* due to the rotation of the rotating element 126*b*, and such that an engagement between the driven gear 172*b* disposed on the second rock arm 126*d* and another driven gear 126*a* is released. Simply speaking, with the rotation of the rotating element 126*b*, the driven gear 127*b* disposed on the second rock arm 126*d* departs from the driven gear 126*a* that originally engaged therewith, as shown in FIG. 7.

After the driven gear 127*b* departs from the driven gear 126*a* engaged therewith, the motive force transferred by the gear chain 126 cannot be transferred anymore because of the lack of the driven gear 127*b* (may be considered as a connector between the driven gears). Thus, a tightly connecting relation is broken, and the rest of the driven gears 126*e* are free floating for the user to release paper jam conveniently.

As mentioned above, when paper jam is occurred in the automatic document feeder 120 or in the media record equipment 100 using the same, only one step that the user has to perform is to open the cover 124 relative to the frame 122, the cam 124*a* disposed on the cover 124 starts to rotate with the rotation of the cover 124 and drives the rotating element 126*b* to rotate, and further the driven gear 127*b* disposed on the second rock arm 126*d* of the rotating element 126*b* is departed from the driven gear 126*a* engaged therewith, and therefore the tightly engagement between the driven gears 126*a* of the gear chain 126 is released and the rest of the driven gears 126*a* can rotate freely such that the user can eject jammed paper conveniently. As such, the user ejects the jammed paper from the driven gears 126*a* with free rotating manner in only one step of opening the cover 124 and pulling the paper with labor-saving.

Referring to FIG. 5, the first rock arm 126*c* and the second rock arm 126*d* of the rotating element 126*b* are perpendicular to each other in substance, but the angle included between the first rock arm 126*c* and the second rock arm 126*d* is not limited by the present embodiment and could be changed according to actual requirements. Ever when the first rock arm 126*c* is interfered by the cam 124*a* to rotate, it falls in the scope of the automatic document feeder 120 and the media record equipment 100 using the same of the present invention.

Referring to FIGS. 5-7, the media record equipment 100 further comprises an elastic element 140 connected between the first rock arm 126*c* and the frame 122, wherein the elastic element 140 is a spring or a rubber band. A hook ring 125 is disposed on a bottom of the frame 122 (as shown in FIG. 6) while the first rock arm 126*c* has a hook ring 128 (as shown in FIG. 5), too, and two ends of the elastic element 140 connected to the hook rings 125 and 128 individually. After jam released, the user close the cover 124 relative to the frame 122, wherein the rotating element 126*b* may go back to a generally original location by self-weight, but the driven gear 127*b* disposed on the second rock arm 126*d* could not engage with the driven gear 126*a* tightly. Thus, the elastic element 140 connected between the rotating 126*b* and the frame 122 can drive the rotating element 126*b* back to the original location precisely by elastic force and make the driven gear 127*b* disposed on the second rock arm 126*d* engage with the driven gear tightly.

Second Embodiment

The second embodiment is similar to the first embodiment, and elements that are equivalent or alike use equivalent or alike references.

Figure 8:
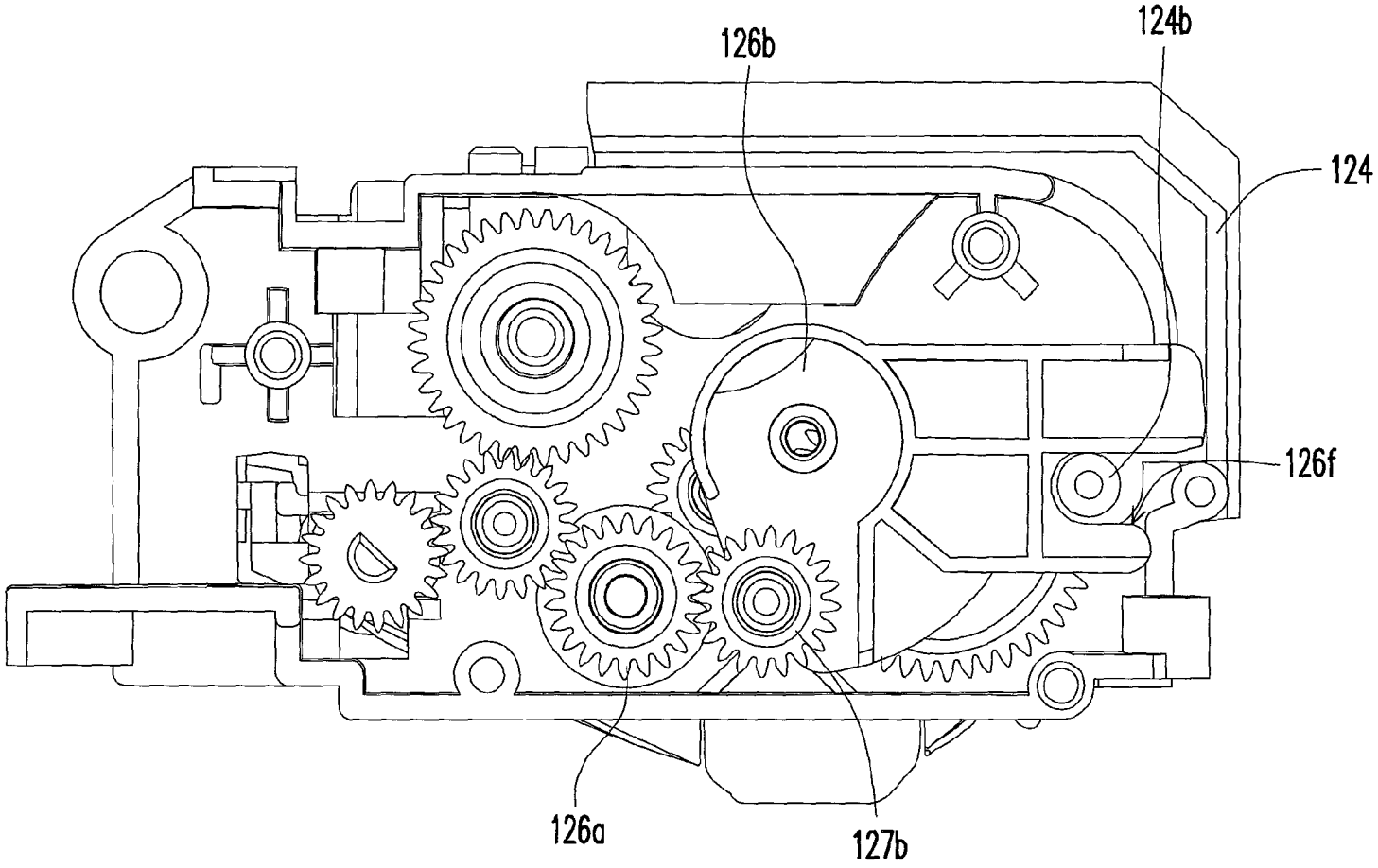
FIG. 8 is a partial schematic view illustrating an automatic document feeder with a cover closing according to a second embodiment.
Figure 9:
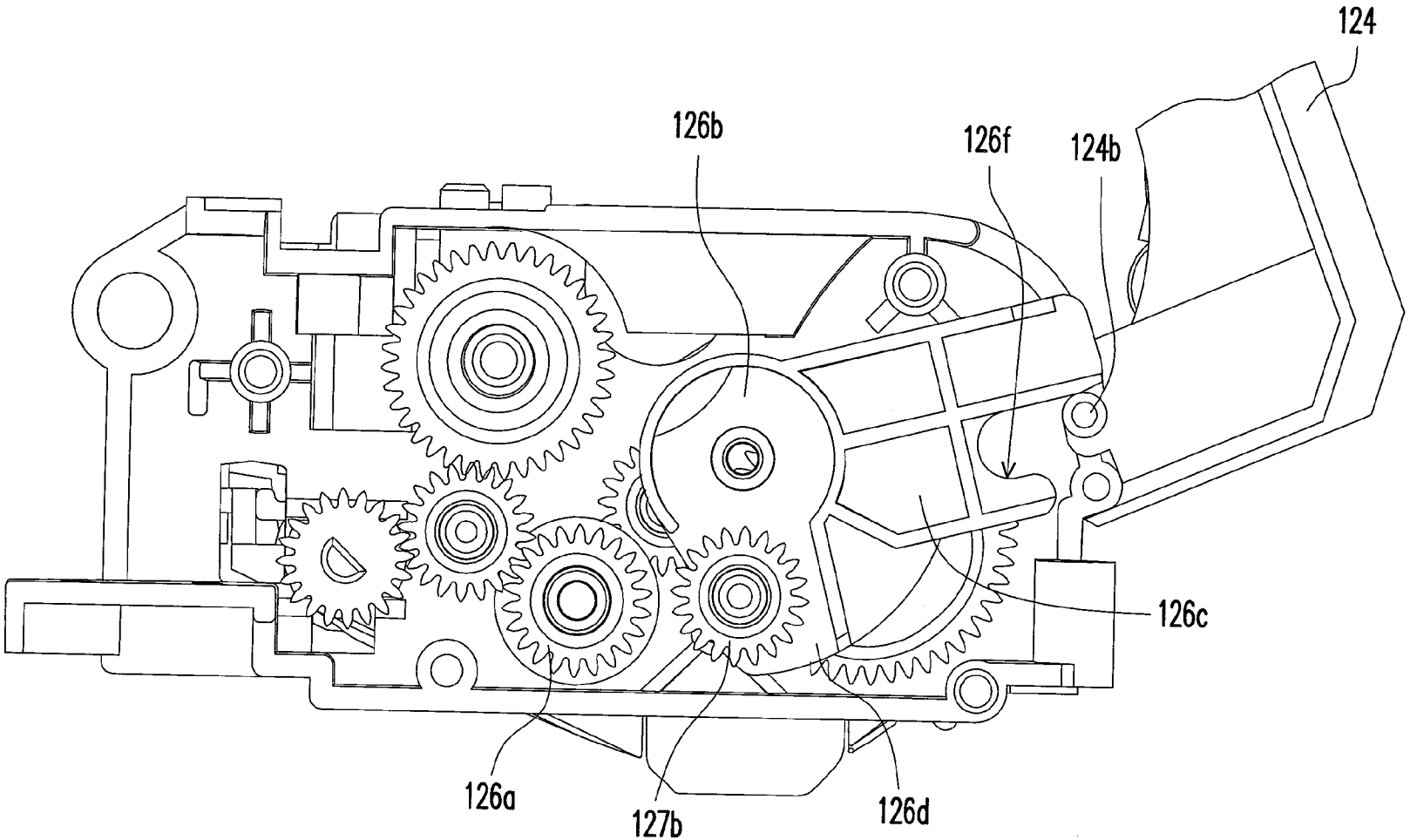
FIG. 9 is a schematic view illustrating the cover of the automatic document feeder in FIG. 8 is open.
Figure 10:
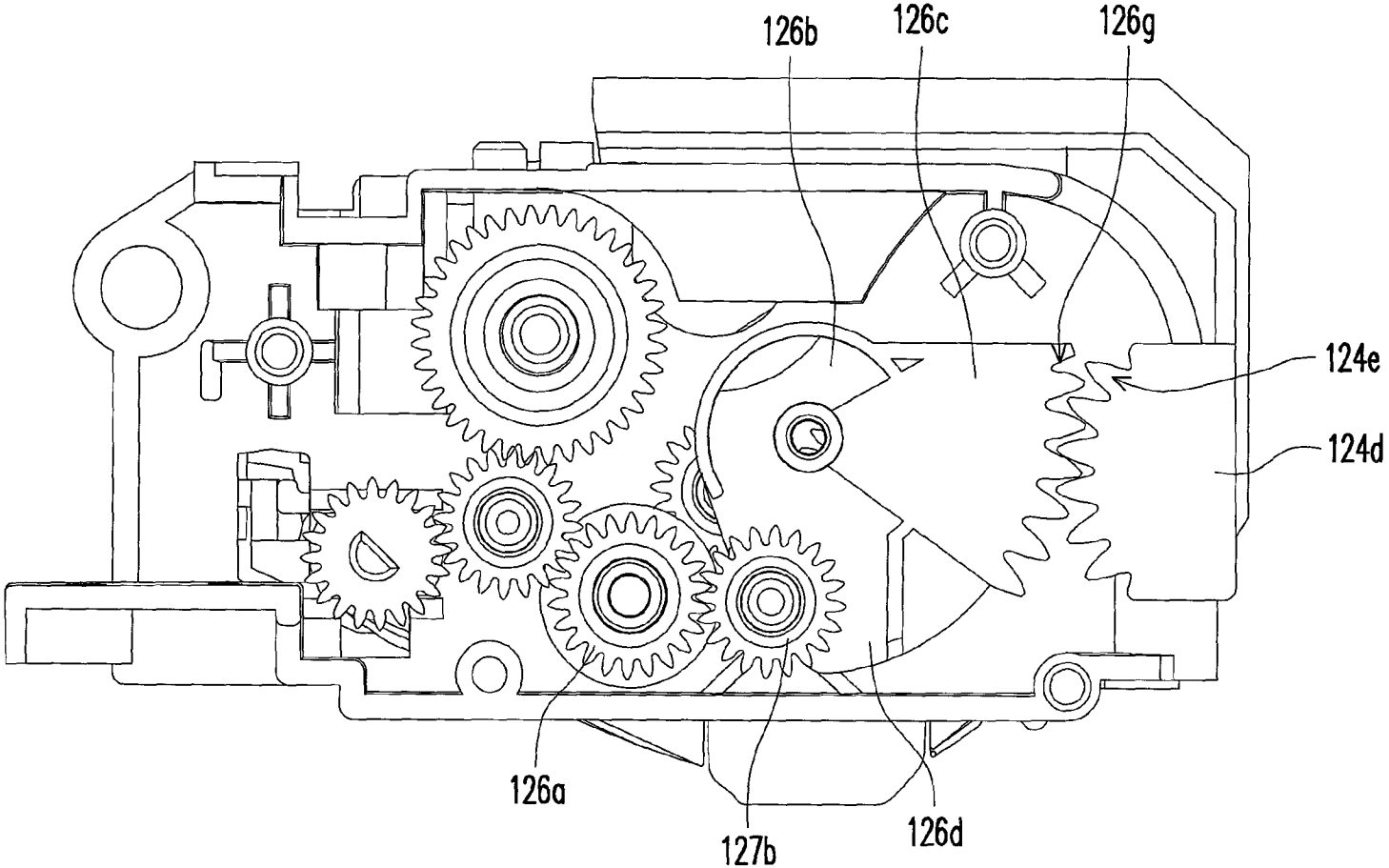
FIG. 10 is a schematic view of an automatic document feeder according to a third embodiment.

FIG. 8 is a partial schematic view illustrating an automatic document feeder with a cover closing according to a second embodiment. Referring to FIG. 8, the cam in the present embodiment is a shaft 124*b*, and the first rock arm 126*c* has an U-shaped opening 126*f*, wherein the shaft 124*b* is located in the U-shaped opening 126*f* when the cover 124 is close relative to the frame 122 (as shown in FIG. 4). FIG. 9 is a schematic view illustrating the cover of the automatic document feeder in FIG. 8 is open. Referring to FIGS. 9-10, the shaft 124*b* located in the U-shaped opening 126*f* moves relative to the rotating unit 126*b* along a profile of the U-shaped opening 126*f*, and props the U-shaped opening 126*f* when the cover 124 opens relative to the frame 122. The rotating unit 126*b* rotates about the first axial direction A1, and the driven gear 127*b* disposed on the second rock arm 126*d* moves away from the driven gear 126*a*.

Third Embodiment

The third embodiment is similar to the above embodiments, and elements that are equivalent or alike use equivalent or alike references.

FIG. 10 is a schematic view of an automatic document feeder according to a third embodiment. Referring to FIG. 10, the difference between the present embodiment and the above two embodiments is that: the cam 124*d* of the present embodiment has a first tooth portion 124*e*, and the first rock arm 126*c* of the rotating unit 126*b* has a second tooth portion 126*g*, and the first tooth portion 124*e* engages with the second tooth portion 126*g*. Through the engagement between the first tooth portion 124*e* and the second tooth portion 126*g*, the rotating unit 126*b* rotates with the opening of the cover 124 relative to the frame 122, and the engagement between the driven gear 127*b* disposed on the second rock arm 126*d* and the driven 126*a* is released; therefore the jammed paper is ejected.

Fourth Embodiment

The third embodiment is similar to the above embodiments, and elements that are equivalent or alike use equivalent or alike references.

Figure 11:
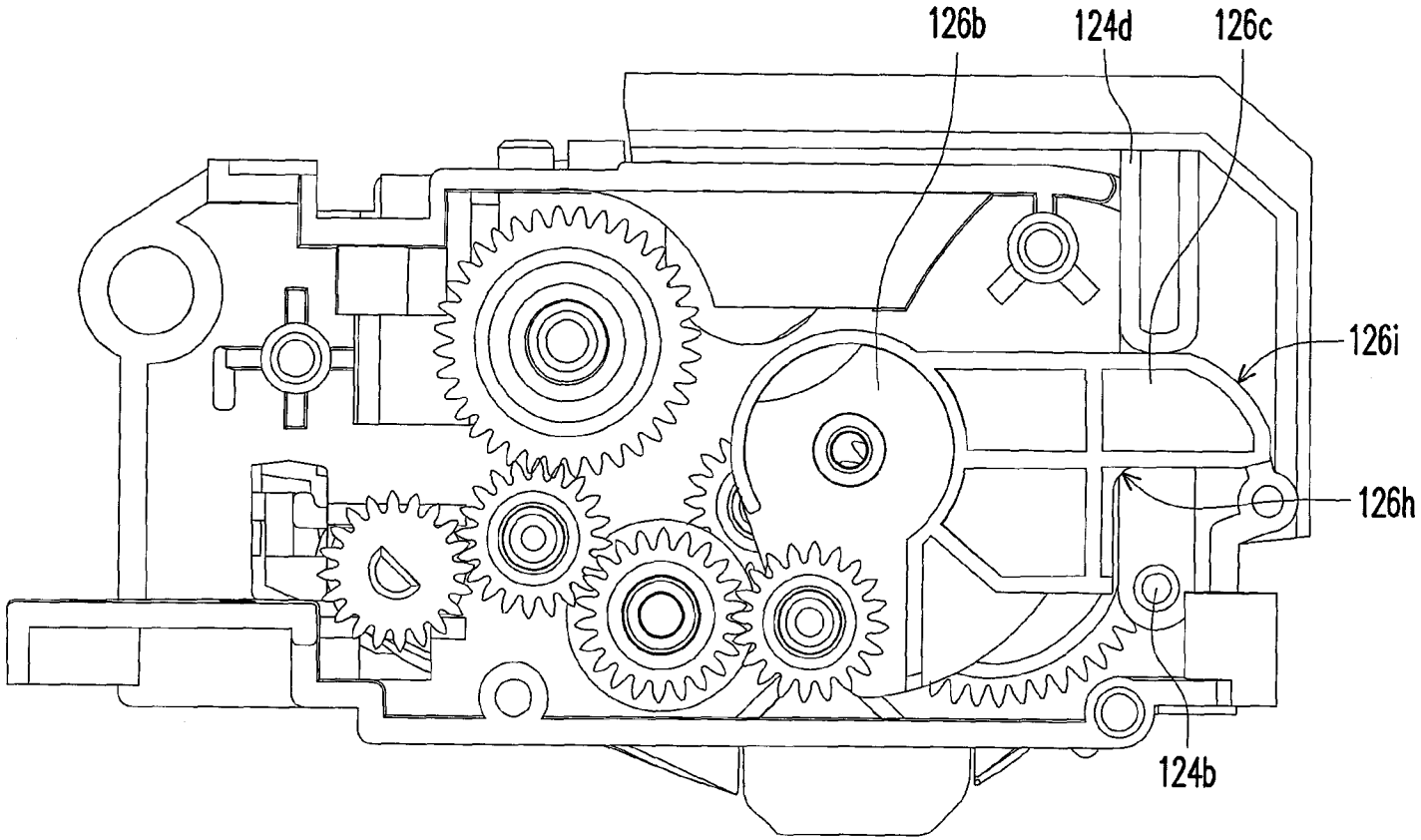
FIG. 11 is a schematic view illustrating an automatic document feeder with a cover is close according to a fourth embodiment.

FIG. 11 is a schematic view illustrating an automatic document feeder with a cover is close according to a fourth embodiment. Referring to FIG. 11, the first rock arm 126*c* of the rotating unit 126*b* has an L-shaped opening 126*h*, and the cam is a shaft 124*b*. The location of the shaft 124*b* is not at the corner of the L-shaped opening 126*h* but disposed around the bottom (not shown) of the L-shaped opening 126*h* close to the main body 110. In other words, the shaft 124*b* distances from the corner of the L-shaped opening 126*h*.

Figure 12:
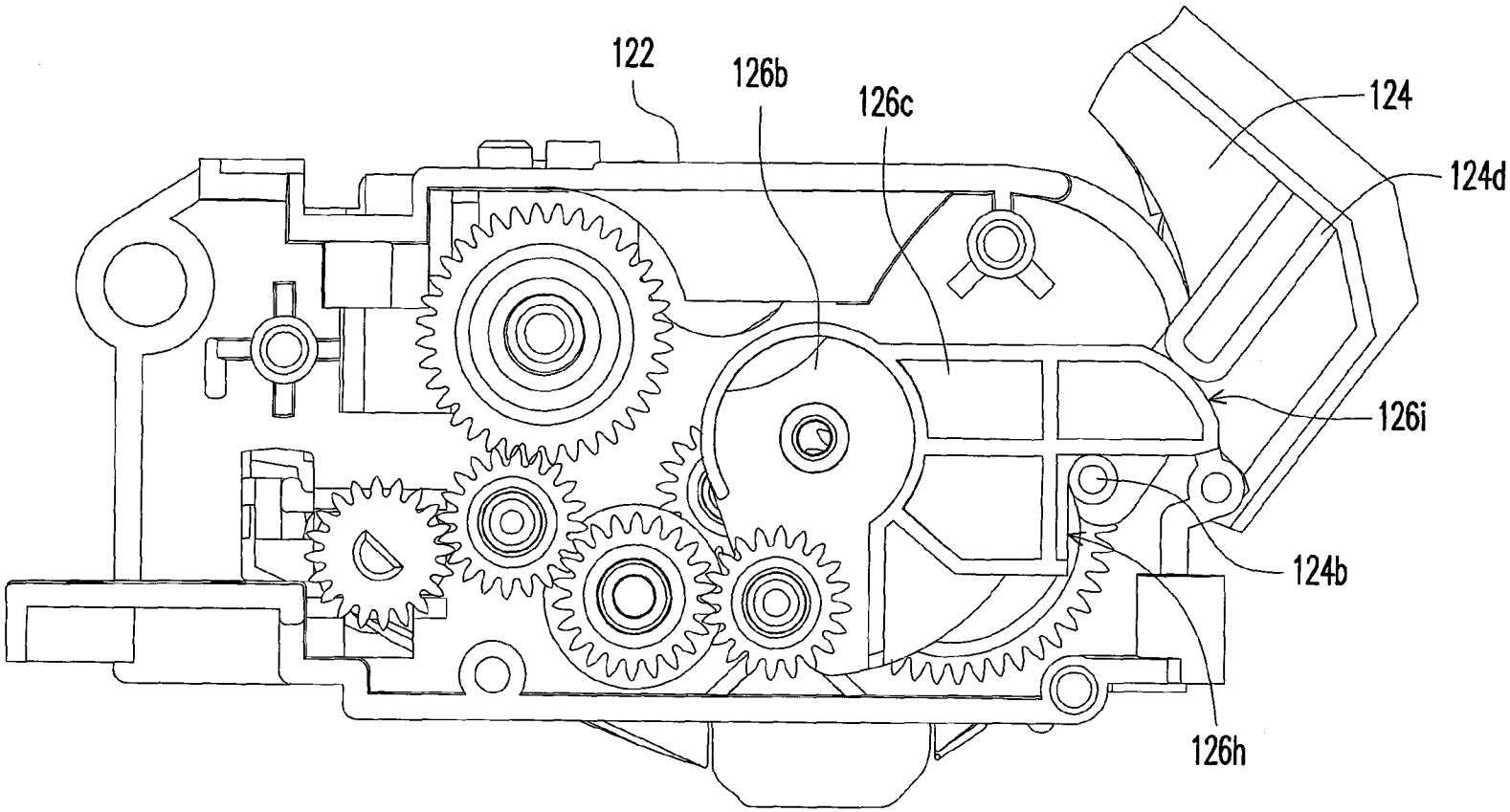
FIG. 12 is a schematic view illustrating the cover of the automatic document feeder according to a FIG. 11 is opening.

FIG. 12 is a schematic view illustrating the cover of the automatic document feeder according to a FIG. 11 is opening. Referring to FIGS. 11 and 12, along with an extent that the cover 124 opens relative to the frame 122, the shaft 124*b* moves along the profile of the L-shaped opening 126*h* to the corner of the L-shaped opening 126*h*.

Figure 13:
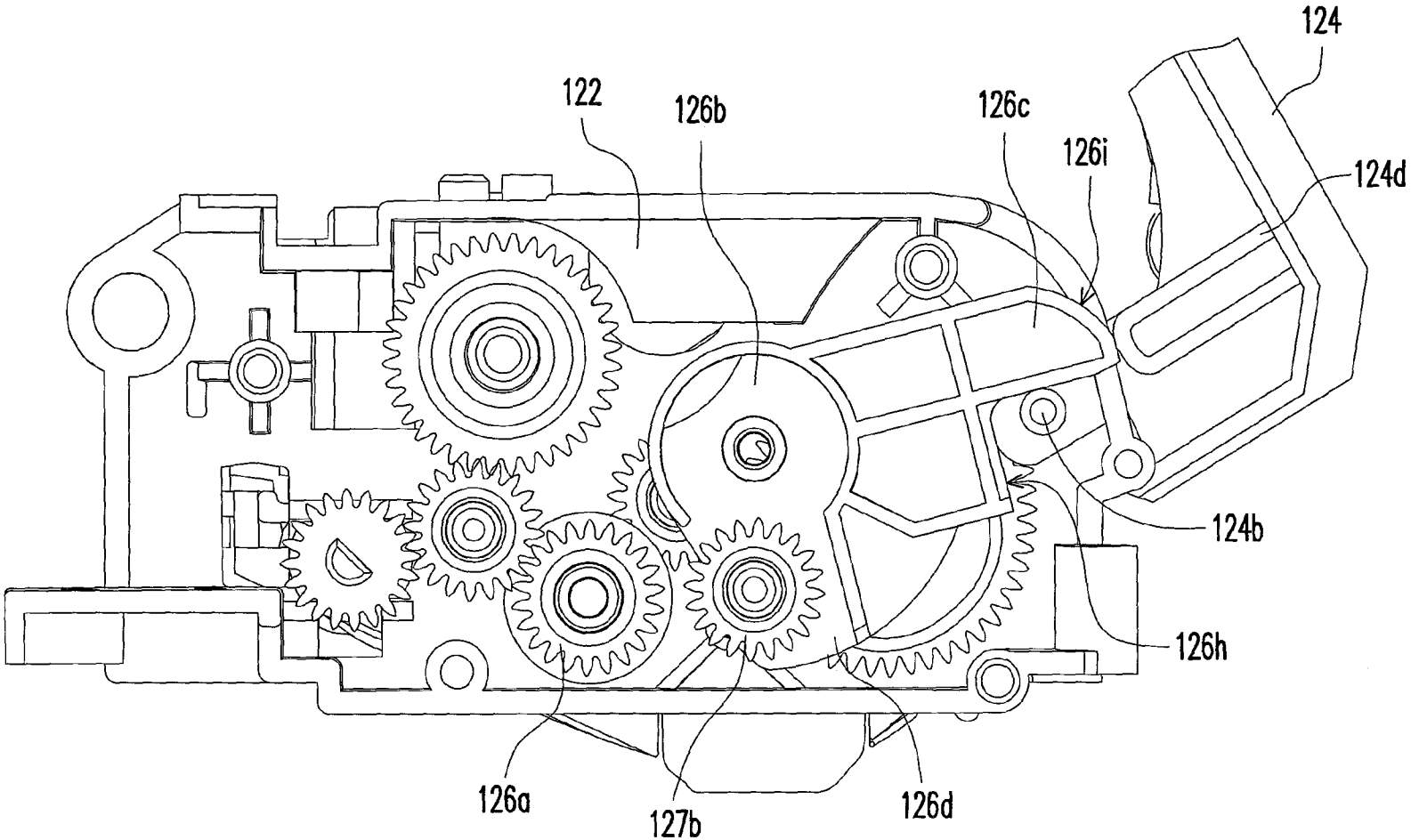
FIG. 13 is a schematic view illustrating the cover of the automatic document feeder according to a FIG. 12 is open.

FIG. 13 is a schematic view illustrating the cover of the automatic document feeder according to a FIG. 12 is open. Referring to FIGS. 12 and 13, when the shaft 124*b* props against the corner of the L-shaped opening 126*h*, with the cover 124 continuously opens relative to the frame 122, the propping of the shaft 124*b* against the first rock arm 126*c* drives the rotating unit 126*b* to rotate, and therefore the engagement between the driven gear 126*a* and the driven gear 127*b* disposed on the second rock arm 126*d* is released.

Compared to the above embodiments, when the cover 124 starts to open relative to the frame 122, the shaft 124*b* serves as the cam would not drive the rotating unit 126*b* to rotate immediately, but the shaft 124*b* drive the rotating unit 126*b* to rotate after the shaft 124*b* moves forward for a distance and props against the first rock arm 126*c*, and thus the rotating unit 126*b* is driven to rotate.

After paper jam is released, in proper order of FIGS. 13, 12 to 11, cover 124 is close the relative to the frame 122. Specifically, a propping element 124*d* is disposed on the cover 124, and the first rock arm 126*c* has a guiding arc 126*i*. The propping element 124*d* moves smoothly relative to the guiding arc 126*i* along the profile of the guiding arc 126*i* when the cover 124 is in the situation of moving to open or to close relative to the frame 122 (such as the cover 124 is not completely opened).

In addition, the propping element 124*d* drives the rotating unit 126*b* to back to the original position completely. In detail, the propping element 124*d* moves relative to the guiding arc 126*i* along the profile of the guiding arc 126*i* when the cover 124 closes relative to the frame 122. When the cover 124 is back to the original position, the propping element 124*d* further props against the first rock arm 126*c*, the propping element 124*d* applies a normal force to the first rock arm 126*c*, and the rotating unit 126*b* is rotated back to the original position; thus, the driven gear 127*b* disposed on the second rock arm 126*d* rotated with the rotation of the rotating unit 126*b* engages with the driven gear 126*a* tightly again, and the gear chain (not shown) transmits power.

In summary, in the automatic document feeder and media record equipment using the same of the invention, the cam disposed on one end of the cover interferes with the rotating element. When the user opens the cover relative to the frame, the driven gear disposed on the second rock arm of the rotating element departs from the driven gear engaged therewith, and therefore a tight engagement between the driven gears of the gear chain is broken, then the rest of the driven gears have free rotating manner and the user can eject paper conveniently and labor-saved from the driven gears having free rotating manner. Since only one step that to open the cover, and therefore the cam disposed on the pivoted end of the cover drives the first rock arm of the rotating unit to depart from the driven gears, and thus the driven gears have free rotating manner, it is convenient and labor-saved for the user to release the paper from the gear chain.

Though the invention has been disclosed above by the embodiments, they are not intended to limit the invention. It will be apparent to one of ordinary skill in the art that modifications and variations to the described embodiments may be made without departing from the spirit and scope of the invention. Therefore, the protecting range of the invention falls in the appended claims.

What is claimed is:

1. An automatic document feeder, comprising:

a frame;

a cover, wherein an end of the cover is pivoted to the frame and therefore the cover can be opened or closed relative to the frame, and the end of the cover pivoted to frame has a cam;

a gear chain disposed in the frame, comprising:

a plurality of driven gears, wherein the driven gears disposed with a first axial direction as a rotating axle are engaged with each other; and a rotating unit, disposed with the first axial direction as the rotating axle and having a first rock arm and a second rock arm, wherein the cam contacts the first rock arm, and one of the driven gears is disposed on the second rock arm, wherein the cover has a propping element while the first rock arm has a first guiding arc, and the propping element props the first rock arm when the cover is closed relative to the frame, and wherein the cam pushes the first rock arm to drive the rotating unit to rotate about the first axial direction with the propping element moving along a profile of the guiding arc, and then an engagement between the driven gear disposed on the second rock arm and another driven gear engaged therewith is released by departing the driven gear disposed on the second rock arm from the driven gear engaged therewith when the cover is opened relative to the frame.

2. The automatic document feeder as claimed in claim 1, wherein the first rock arm has an L-shaped opening, and the cam is located in the L-shaped opening when the cover is closed relative to the frame.

3. The automatic document feeder as claimed in claim 2, wherein the cam is a shaft, and the shaft distances from the corner of the L-shaped opening when the cover is closed relative to the frame.

4. The automatic document feeder as claimed in claim 1, wherein the first rock arm has a U-shaped opening while the cam is a shaft, and the shaft is located in the U-shaped opening when the cover is closed relative to the frame.

5. The automatic document feeder as claimed in claim 1, wherein the cam has a first tooth portion, the first rock arm has a second tooth portion, and the first tooth portion is engaged with the second tooth portion.

6. The automatic document feeder as claimed in claim 1, wherein the gear chain comprises a driving gear disposed with a second axial direction perpendicular to the first axial direction as the rotating axle, and the driving gear is engaged with one of the driven gears.

7. The automatic document feeder as claimed in claim 6, wherein the driven gear engaged with the driving gear is different from the driven gear disposed on the second rock arm.

8. The automatic document feeder as claimed in claim 1, wherein the frame has a plurality of fixing structures disposed around outside of the driven gears.

9. The automatic document feeder as claimed in claim 8, wherein the fixing structures are apertures.

10. The automatic document feeder as claimed in claim 8, further comprising a plurality of fixing units passing through the fixing structures individually.

11. The automatic document feeder as claimed in claim 1, further comprising an elastic element connected between the first rock arm and the frame.

12. The automatic document feeder as claimed in claim 11, wherein the elastic element is a spring or a rubber band.

13. The automatic document feeder as claimed in claim 11, each of a bottom of the frame and the first rock arm has a hook ring, and two ends of the elastic element connect to the hook rings individually.

14. A media record equipment, comprising:

a main body;

an automatic document feeder disposed on the main body, comprising:

a frame;

a cover, wherein an end of the cover is pivoted to the frame and therefore the cover could be opened or closed relative to the frame, and the end of the cover pivoted to the frame has a cam;

a gear chain, disposed in the frame and having a plurality of driven gears and a rotating unit, wherein the driven gears are engaged with each other and disposed with a first axial direction as the rotating axle, the rotating unit has a first rock arm and a second rock arm, the cam contacts the first rock arm, and one of the driven gears is disposed on the second rock arm, wherein the cover has a propping element while the first rock arm has a first guiding arc, and the propping element props the first rock arm when the cover is closed relative to the frame, and wherein the cam pushes the first rock arm to drive the rotating unit to rotate about the first axial direction with the propping element moving along a profile of the guiding arc, and then an engagement between the driven gear disposed on the second rock arm and another driven gear engaged therewith is released by departing the driven gear disposed on the second rock arm from the driven gear engaged therewith when the cover is opened relative to the frame.

15. The media record equipment as claimed in claim 14, wherein the first rock arm has an L-shaped opening, and the cam is located in the L-shaped opening when the cover is closed relative to the frame.

16. The media record equipment as claimed in claim 15, wherein the cam is a shaft, and the shaft distances from the corner of the L-shaped opening when the cover is closed relative to the frame.

17. The media record equipment as claimed in claim 14, wherein the first rock arm has a U-shaped opening while the cam is a shaft, and the shaft is located in the U-shaped opening when the cover is closed relative to the frame.

18. The media record equipment as claimed in claim 14, wherein the cam has a first tooth portion, the first rock arm has a second tooth portion, and the first tooth portion is engaged with the second tooth portion.

19. The media record equipment as claimed in claim 14, wherein the gear chain further comprises a driving gear disposed with a second axial direction perpendicular to the first axial direction as the rotating axle, and the driving gear is engaged with one of the driven gears.

20. The media record equipment as claimed in claim 19, wherein the driven gear engaged with the driving gear is different from the driven gear disposed on the second rock arm.

21. The media record equipment as claimed in claim 14, wherein the frame has a plurality of fixing structures disposed around outside of the driven gears.

22. The media record equipment as claimed in claim 21, wherein the fixing structures are apertures.

23. The media record equipment as claimed in claim 21, further comprising a plurality of fixing units passing through the fixing structures to fix the frame on the main body.

24. The media record equipment as claimed in claim 14, further comprising an elastic element connected between the first rock arm and the frame.

25. The media record equipment as claimed in claim 24, wherein the elastic element is a spring or a rubber band.

26. The media record equipment as claimed in claim 24, wherein each of a bottom of the frame and the first rock arm has a hook ring, and two ends of the elastic element connect to the hook rings individually.

* * * * *